US005997375A

United States Patent [19]

Vukelic et al.

[11] Patent Number: 5,997,375

[45] **Date of Patent: *Dec. 7, 1999**

[54] PULL-ON STRAP WAKEBOARD BINDING AND SYSTEM

[75] Inventors: Gregg A. Vukelic, Seattle, Wash.; Eric S. George, Taunton, Mass.

[73] Assignee: Earth & Ocean Sports, Inc., Hyannis, Mass.

[ * ] Notice: This patent is subject to a terminal disclaimer.

[21] Appl. No.: 09/321,997

[22] Filed: May 28, 1999

Related U.S. Application Data

[63] Continuation of application No. 09/080,069, May 15, 1998, Pat. No. 5,910,034.

[51] Int. Cl.[6] ..... B63B 35/85

[52] U.S. Cl. ..... 441/70

[58] Field of Search ..... 441/68–70; 36/138

[56] References Cited

U.S. PATENT DOCUMENTS

| | | | |
|---|---|---|---|
| 5,624,291 | 4/1997 | Mcclaskey | 441/70 |
| 5,868,594 | 2/1999 | Vukelic et al. | 441/70 |
| 5,910,034 | 6/1999 | Vukelic et al. | 441/70 |

*Primary Examiner*—Ed Swinehart
*Attorney, Agent, or Firm*—Richard P. Crowley

[57] ABSTRACT

A pull-on wakeboard binding which includes a heel receptacle with an outer rear surface, and a pull-on strap which is secured longitudinally and centrally to the rear exterior surface of the heel receptacle. The pull-on strap includes an upper open loop to be grasped by a user to assist in the pulling on of the binding and a secured first and second strap section to form an open load-transfer intermediate loop between the sections.

16 Claims, 10 Drawing Sheets

PULL-ON STRAP WAKEBOARD BINDING AND SYSTEM

REFERENCE TO PRIOR APPLICATION

This application is a continuation of U.S. patent application Ser. No. 09/080,069, filed on May 15, 1998, now U.S. Pat. No. 5,910,034, issued Jun. 8, 1999.

BACKGROUND OF THE INVENTION

Wakeboard bindings are foot bindings which are adapted and designed to be employed on a wakeboards, wherein the wakeboard is a recreational sport board, so that the person riding on the wakeboard can be towed behind a boat or jet ski. Wakeboard bindings are generally mounted transversely on a wakeboard, similar to bindings mounted on a snowboard. One wakeboard binding is described in U.S. Pat. No. 5,624,291, issued Apr. 29, 1997.

It is therefore desirable to provide for a new and improved wakeboard bindings and wakeboard system containing the bindings, which wakeboard bindings and system provides certain advantages over the prior art in regard to performance, use, and structure.

SUMMARY OF THE INVENTION

The invention relates to wakeboard bindings and a wakeboard system employing the bindings.

The wakeboard binding of the invention is adapted to be secured to a wakeboard, which binding comprises a bottom support plate, typically of aluminum, having a front end, a rear end, a left edge, a right edge, a top surface, and a bottom surface, and characterized by a left row of a plurality of apertures, and a right row of a plurality of apertures. The wakeboard binding includes a cushion foot pad, typically of a molded, flexible foam material of various colors and usually die cut to size. The wakeboard binding includes a heel receptacle having a back surface and a lower edge, with a plurality of apertures generally aligned with the apertures on the support plate, and the heel receptacle extending about the back of the heel of a user. The wakeboard binding also includes a toe receptacle having a top surface and a left and right end, each with a plurality of apertures, and generally aligned with the apertures of the support plate and extending across the top of the foot of a user. The toe and heel receptacle material is usually composed of a rubber sheet material, and more particularly, an elastomeric metallocene rubber (EMR) which may be physically bonded to a foam sheet material and die cut to size to provide interior comfort. The EMR and the foam material may vary in density, thickness and color, such as, the foam material having about 22 pounds per cubit foot density and about 0.185 inch thickness and screened with selected graphics. The heel and toe receptacle form a boot-like enclosure on the top surface of the support plate over and about the selected foot pad to receive the foot of the user.

The wakeboard binding includes a binding overlay comprising a single piece of a sheet material having a top, a bottom, and a base section to extend about the surface of the heel receptacle and with an open bottom, heel cup section to extend over and across the heel of a user, and a top left and a top right outwardly elongated, spaced apart, extending arms from the base section, and a bottom left and a bottom right outwardly elongated, spaced apart, extending arms from the base section, and generally, the arms being of a uniform length and parallel to each other. Each arm at the end thereof has a plurality of apertures therein, generally, the apertures are aligned to be adjustably secured to a plurality of apertures in the bottom support plate. The top and bottom arms of the binding overlay are adapted to extend over and across the top surface of the toe receptacle in a crisscross arm relationship. The binding overlay usually comprises a rubber sheet material, and more particularly, a one piece, die cut, EMR sheet material with adjustable holes punched, as desired, for alignment with the apertures in the support plate. The EMR material permits varying selected properties to be employed, such as, varying the density, thickness, or color of the material.

The wakeboard binding also includes a means to clamp respectively, the ends of the extending arms of the binding overlay and the toe and heel receptacle, through the respective apertures, to and into the top surface of the bottom plate by the employment of adjustable, stainless steel machine screws. The support plate typically is formed of an anodized aircraft aluminum, for example, having a thickness of about 0.100 inches. The means to clamp comprises left and right toe bars with holes therein and a molded heel horseshoe-type clamp, through which stainless steel machine screws or bolts may be employed to secure the sides of the toe and heel receptacle and the arms of the binding overlay to the support plate. The wakeboard binding may include an adjustable opening means in the top back of the binding overlay to permit the easier entry of a user's foot into the boot enclosure, such as, the employment of a zipper or an extended pull-on strap. In addition, the heel and toe receptacle may also include on the top surface thereon, a pair of spaced apart holes aligned on the heel and toe receptacle to aid a user in placing his foot into the boot-like receptacle.

The support plate is characterized by a heel aperture, usually directly positioned beneath the heel of a user, which aperture may, for example, be a rounded trapezoid or other shape aperture and which would include therein a heel cushioning material, such as; but not limited to, a resilient honeycomb air-cell, plastic heel cushion material, die cut to size and of about ¼ inch thickness. The support plate may also be characterized by a substantially circular arc or arcuate, generally open section, centrally located and extending inwardly from the front end of the support plate.

The construction of the wakeboard binding of the invention provides for a plurality of improvements in the structure, performance, and use of the wakeboard binding.

The support plate enables the user to not only rotate each binding to various degrees, but also enables the user to move the plate forward and back over the width of the wakeboard. This allows for users with smaller and larger feet to be centered over the wakeboard.

The keyway system of heel and front apertures allows the manufacturer to use less aluminum material to produce the plate part, thus reducing the weight of the plate. The keyway system also allows the manufacturer to use the same plate for the various sizes. A specialized keyway insert can be put in to handle all types of footbed shapes.

The hardware used comprises a polymer molded, e.g., nylon toe bar and heel horseshoe clamps, optionally, with adjustable overlay bars. The hardware system allows the user to adjust the tension on the binding overlay, with overlay bars, through arm length adjustment, without disassembling the entire heel and toe pieces. In one embodiment, instead of running the overlay under the same hardware that the heel and toe are under, there are separate overlay bars that clamp the overlay between the two pieces of nylon hardware. This system enables the user to rotate the overlay around the radius of the heel horseshoe shape and back and forth along the toe bars. This gives each user the ability to easily modify their bindings to fit their comfort needs. All users usually modify their bindings currently, but it is very difficult because all the material is clamped under the same bars.

The support plate is characterized by a machined hole in the plate directly under the heel of the user. This space allows for a die cut piece of the honeycomb air-cell to be placed in direct contact with the bottom of the footbed pad. This provides the user with a cushion material directly under the heel. The cushion provides a softer landing on air tricks and also absorbs the kinetic energy. Less energy being pushed into the wakeboard will lengthen the board life and comfort the user.

EMR material has been developed to lessen the weight of the binding and enable the binding manufacturer to use various densities, thicknesses, and colors. Currently, the industry has used neoprene rubber to produce bindings, so all bindings developed in the industry have the same black look and characteristics. The (EMR) material allows the wake binding quickly to adjust to the changing needs of the market as to color, color combinations, and comfort.

The binding overlay is a single piece of die cut sheet material. The shape of the overlay is a direct function of certain qualities needed to produce a high-end binding. The heel area is cut out, providing a heel cup or a "pocket" to keep the user's heel locked down in place. The bottom two arms of the overlay are crisscrossed over the top of the toe piece. This provides a user with adjustable support over their toe, minimizing any toe lift. The top two arms of the overlay are also crisscrossed and pulled around to the backsides of the heel horseshoe hardware. The tension and placement of this part of the overlay is also adjustable. These arms are a key part to the overlay binding. Depending on the desired tension by the user, the top arms pull the user's foot and ankle back into the heel "pocket" of the binding. This will minimize the heel lift when performing surface and air tricks. The less heel lift within the binding, the more direct edge control of the wakeboard.

The tight tension created by this binding overlay made it difficult to put on and take off the binding. This lead to the optional, but suggested, addition of the rear entry binding system. The binding can now be put on and taken off easily and still maintain the tight tension qualities needed in a performance wakeboard binding.

Optionally and preferably, an ankle strap is sewn in place along the top edge of the binding overlay providing the last element needed to prevent any heel lift. This strap, pulled tight around the user's ankle through a D-ring and back around the ankle, sticking onto itself with the VELCRO™ (hook and loop fabric), will keep the user's entire foot down in the heel "pocket". The ankle strap allows the high-end rider to be physically restrained into the binding. The foot is able to be pulled out of the binding, but centrifugal force and gravity will not allow the binding to slip during surface or air maneuvers.

In a further embodiment of the invention, which embodiment may be employed generally in wakeboard bindings as a heel receptacle, and particularly with wakeboard bindings having an integral binding overlay as described, the heel receptacle may employ a strap secured thereto to aid in the insertion of a user's foot into the boot-like enclosure.

A sturdy strap, like woven nylon strap, has a top loop extending above the top of the heel receptacle material, e.g., 1 to 3 inches, so that the user may grasp the open loop for assistance in pulling on the wakeboard binding. This loop replaces the use of finger holes presently employed in the art which has been found to sometimes cause ripping of the heel receptacle material.

The strap extends generally centrally down the outside of the heel receptacle and is firmly secured, typically by stitching it to an upper and lower section of the heel receptacle to form an intermediate free loop between the stitched secured section. This arrangement transfers the load or user pulling force to the strap, rather than to the heel material and avoids tearing or ripping of the heel receptacle material in use.

The strap is turned over at the lower end to the lower secured section to form a lower strap loop. This lower loop is for anchoring purposes and is designed so that the heel clamp used, generally the horseshoe-shaped heel clamp, passes through the lower loop to anchor the lower end of the strap securely to the heel clamp which is bolted to the support plate.

The extended, multiple loop, secured strap may be used alone to aid insertion of a user foot into the wakeboard binding, or in combination with a back closure, such as a zipper, in the wakeboard binding overlay adjacent the back heel enclosure.

The invention shall be described for the purposes of illustration only in connection with certain illustrated embodiments; however, it is recognized that various modifications, additions, improvements, and changes to the illustrated embodiments may be made by those persons skilled in the art without departing from the spirit and scope of the invention as disclosed and claimed.

DESCRIPTION OF THE EMBODIMENTS

Figure 1:
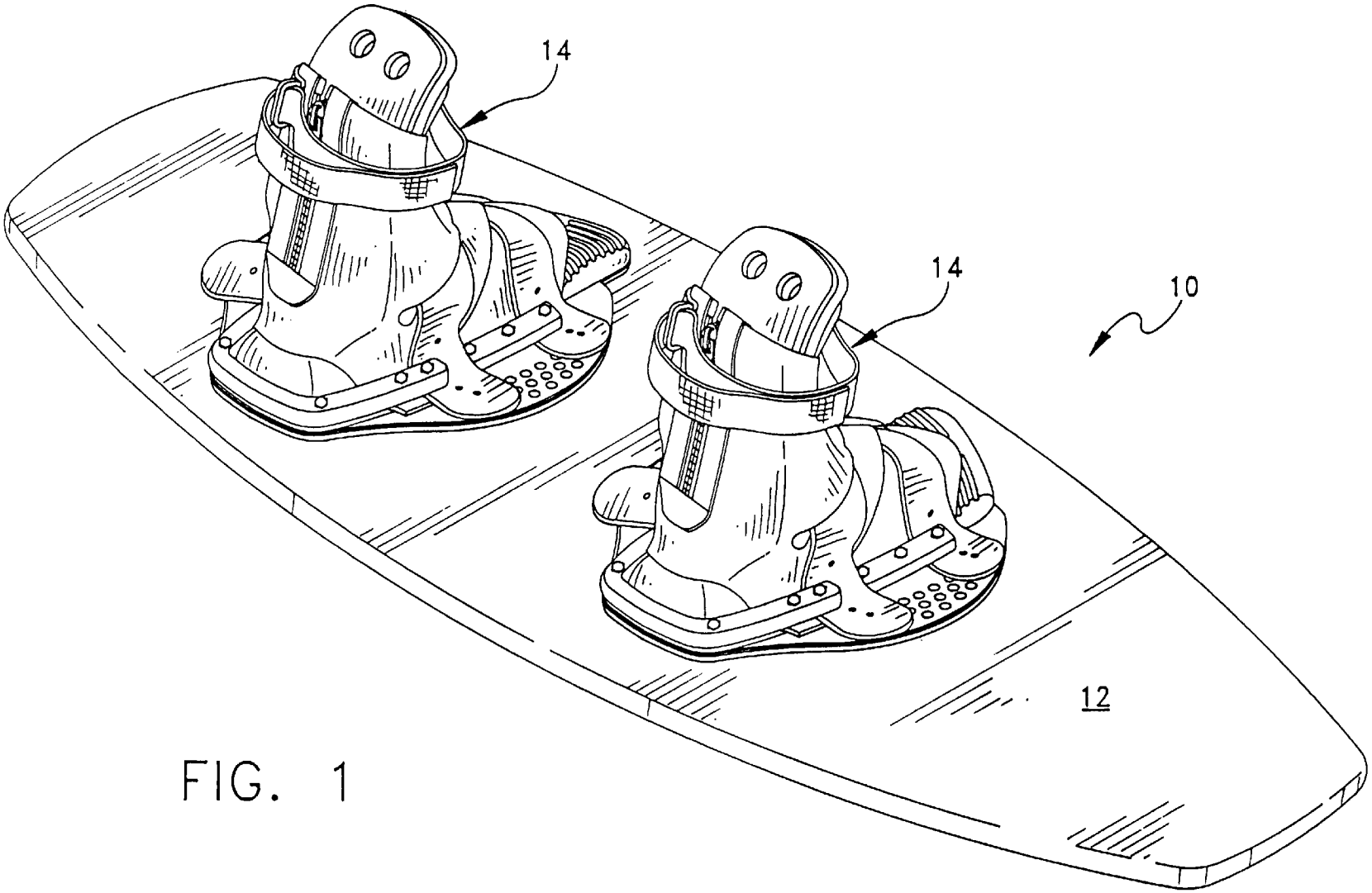
FIG. 1 is a perspective view of a wakeboard with a pair of wakeboard bindings secured thereon.

FIG. 1 is a perspective view of a wakeboard system 10 showing wakeboard 12 and a pair of transversely mounted wakeboard bindings/wakeboard boots 14 mounted on the top surface of the wakeboard.

Figure 2:
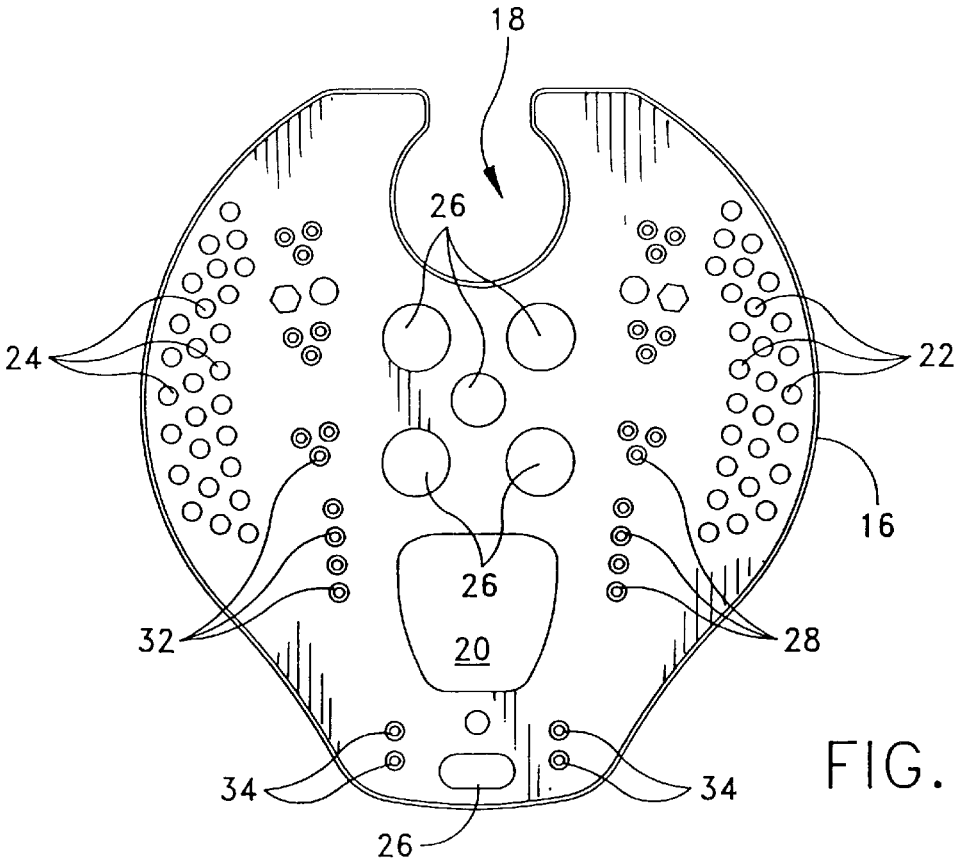
FIG. 2 is a bottom plan view of the support plate of the wakeboard system without the honeycomb cushion material.
Figure 3:
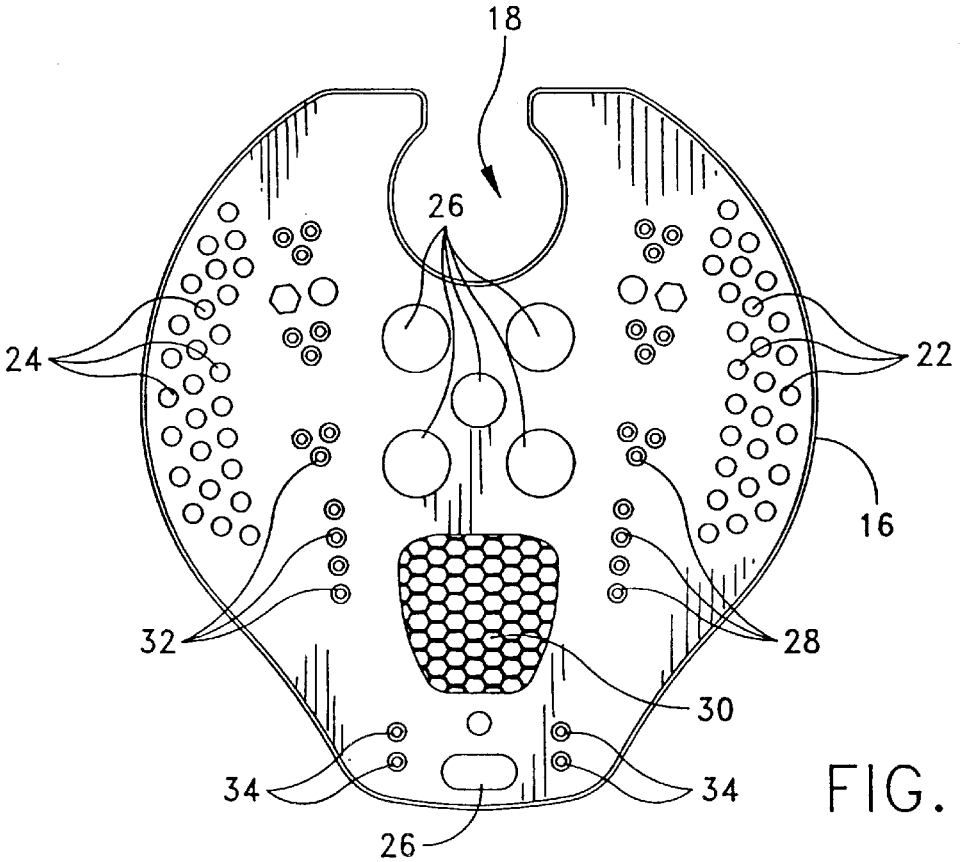
FIG. 3 is a bottom plan view of the support plate of FIG. 1 illustrating the honeycomb cushion material in the heel aperture.

FIGS. 2 and 3 are bottom plan views of the wakeboard binding/boot 14, FIG. 2 illustrating the bottom support plate 16 of the wakeboard binding 14 illustrating a trapezoidal heel cavity 20, while FIG. 3 illustrates the honeycomb (typically hexagonal open cell plastic) cushion material 30 inserted in the heel cavity 20. FIGS. 2 and 3 illustrate the aluminum support plate 16 having a front archward-type, about 270 degree front opening 18 and with a plurality of spaced apart apertures 22 on the right hand side and 24 on the left hand side of the support plate 16. The aluminum support plate 16 also includes a plurality of other holes 26, the primary purpose is merely to reduce the weight of the support plate 16. Also illustrated are bolt heads 28, 32, and 34.

Figure 4:
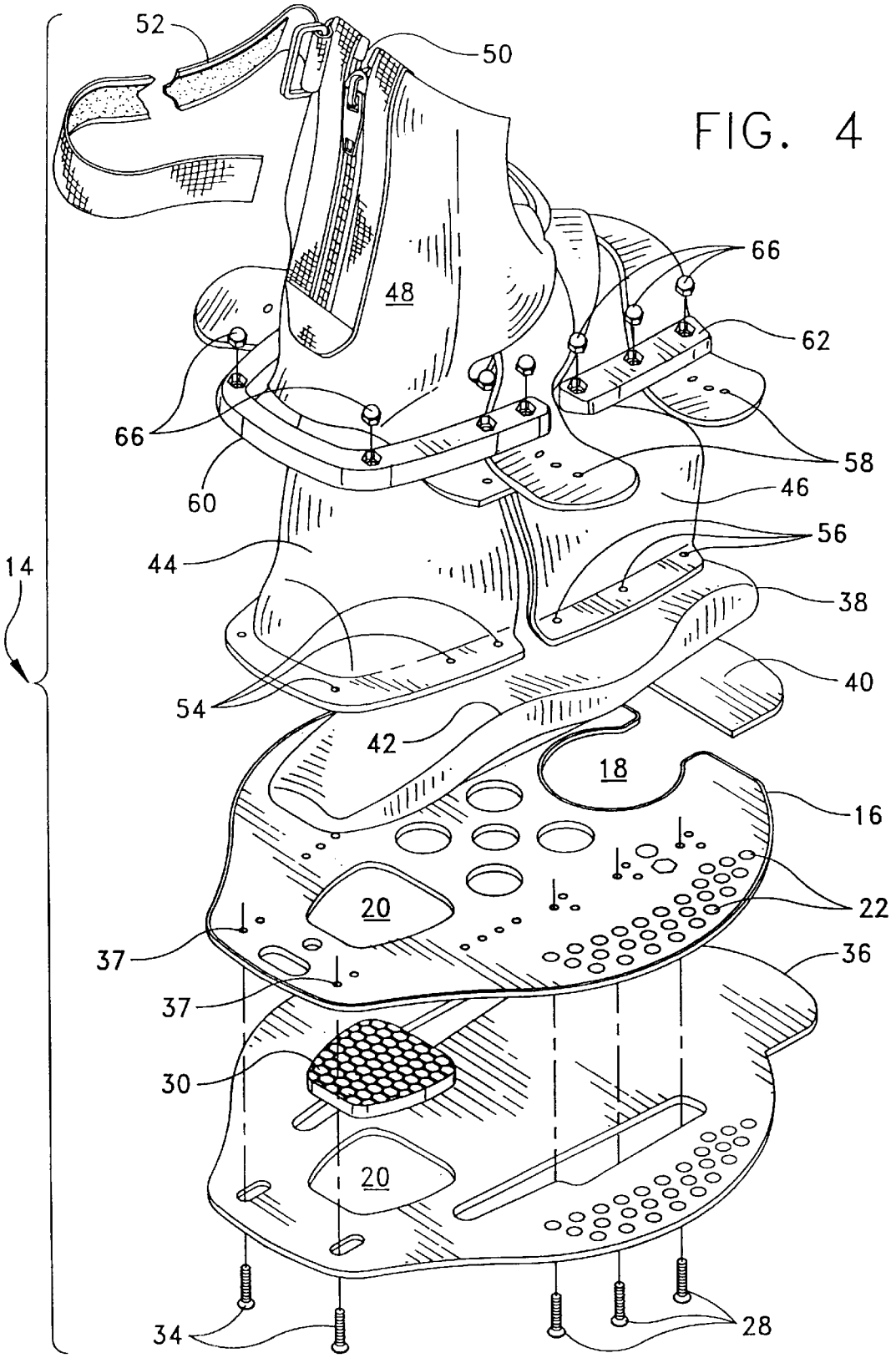
FIG. 4 is an exploded, perspective, back side view of the wakeboard binding.
Figure 5:
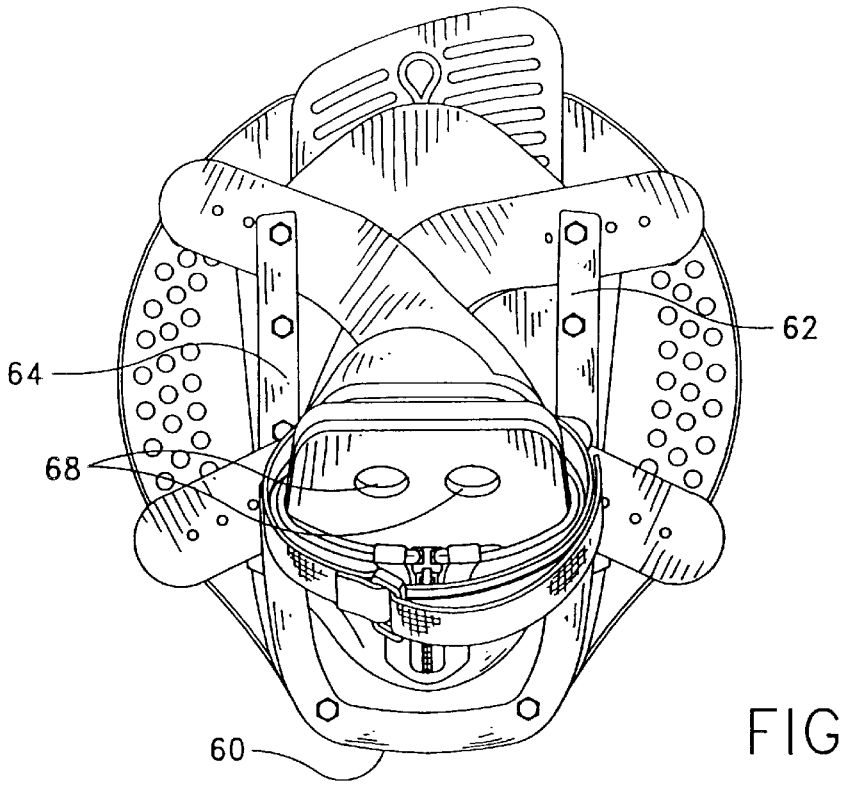
FIG. 5 is a top plan view of the wakeboard binding.
Figure 6:
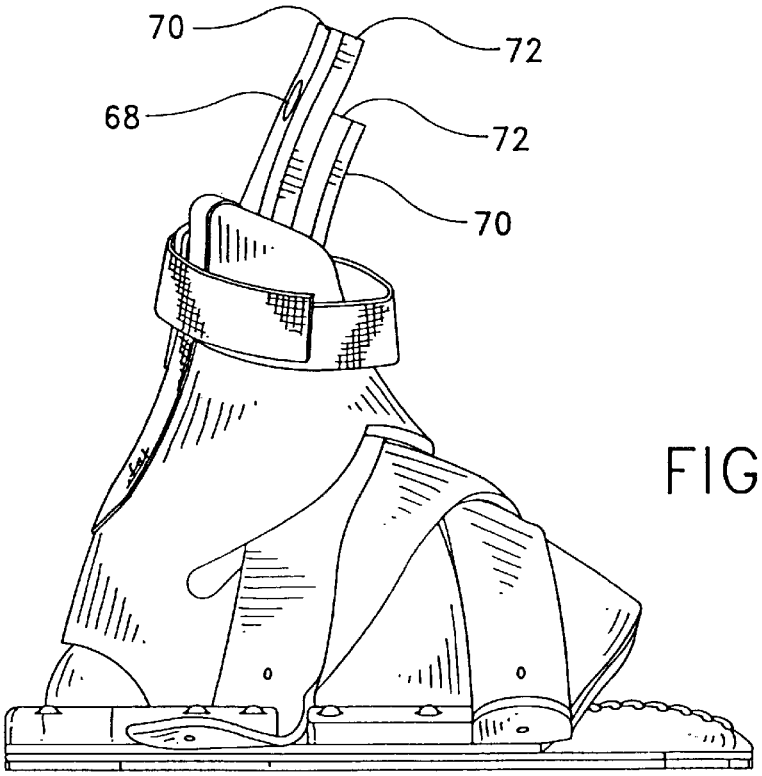
FIG. 6 is a side plan view of the wakeboard binding.
Figure 7:
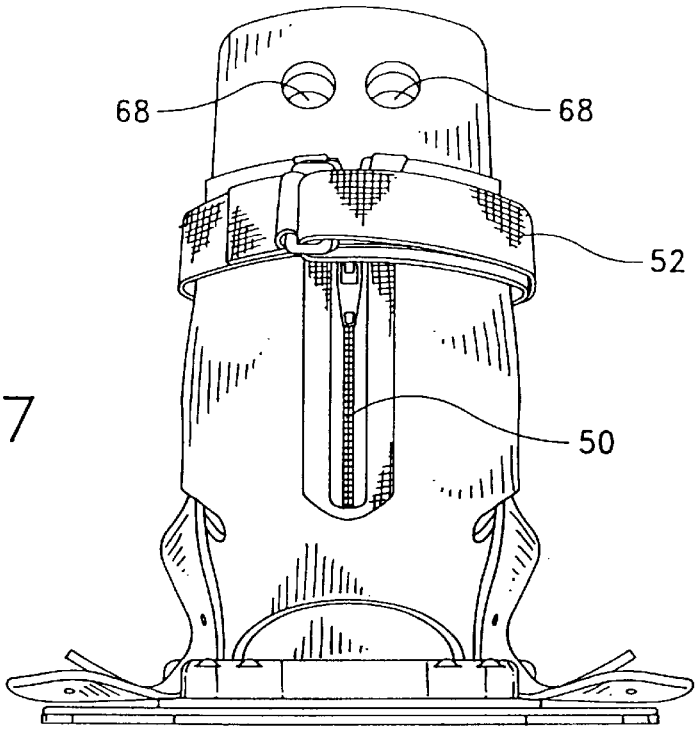
FIG. 7 is a rear plan view of the wakeboard binding.
Figure 8:
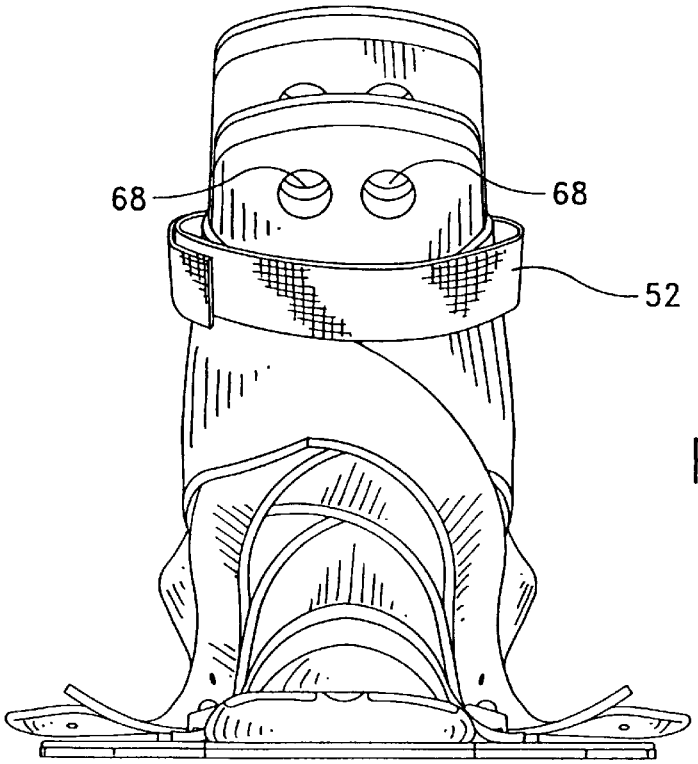
FIG. 8 is a front plan view of the wakeboard binding.
Figure 9:
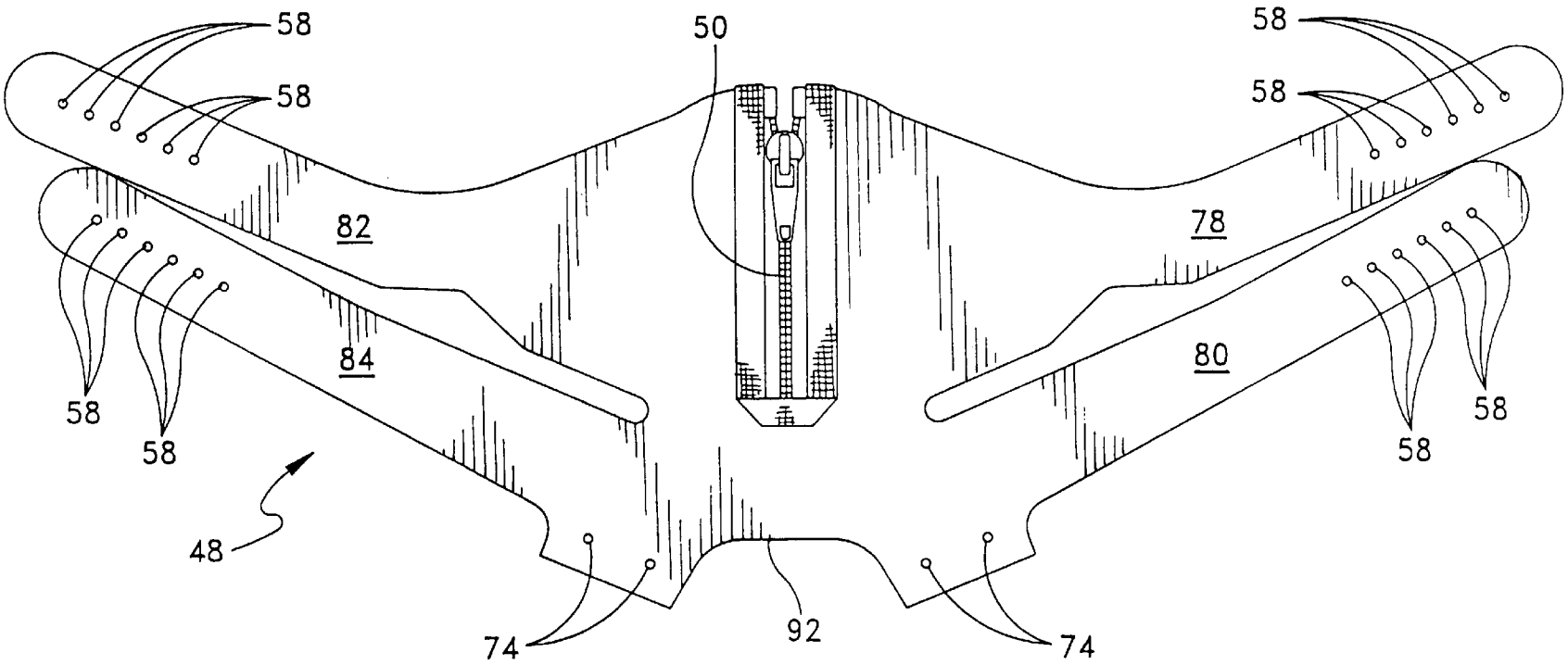
FIG. 9 is a back plan view of the binding overlay used on the wakeboard binding.

FIG. 4 is an exploded perspective view from the back side of the wakeboard binding 14 of the invention showing a bottom foam or rubber layer 36 which is secured to the bottom surface of the aluminum support plate 16 and a foam foot pad 38 having an arch 42 and typically formed of 4 to 6 pounds of EVA foam and with an extended support toe piece 40 also of EVA foam. A heel receptacle is illustrated in heel sheet receptacle material element 44 and a toe sheet material receptacle element 46, while 48 represents a single piece, die cut, binding overlay 48 (see FIG. 9). The binding overlay 48 includes a rear zipper 50 for ease of entry and comprises a one piece, die cut, EMR material with adjustable holes 58 and each extending arm 78, 80, 82, and 84 and rear heel holes 74 and open heel receptacle 92. The wakeboard binding 14 also has an ankle strap 52 and with the heel receptacle 44 and the toe receptacle 46 having the respective holes on the flanges 54 and 56 which are to be aligned with the respective holes 37 in the support plate 16. The binding 14 also includes a nylon molded toe bar 62 and 64 and a nylon molded horseshoe-type heel clamp 60 and with respective bolt nut 66 and holes in the heel 68 and the heel element 44 and the binding overlay 48.

The binding overlay 48 comprises a one piece, die cut rubber, typically of EMR material, with the adjustable holes 58 punched in each of the peripheral ends of the arms 78, 80, 82, and 84, with tension adjustment of the arms in place. The heel element 44 and toe element 46 are composed of elastomeric metal seam rubber, EMR material, 70 and the material physically bonded to an interior foam-type material 72, for example, having a EVA foam density of about 18 to 24 pounds per cubit foot and with the EMR layer 70 layer being of a different color, for example, yellow or red to contrast with the gray or black foam layer 72.

Figure 10:
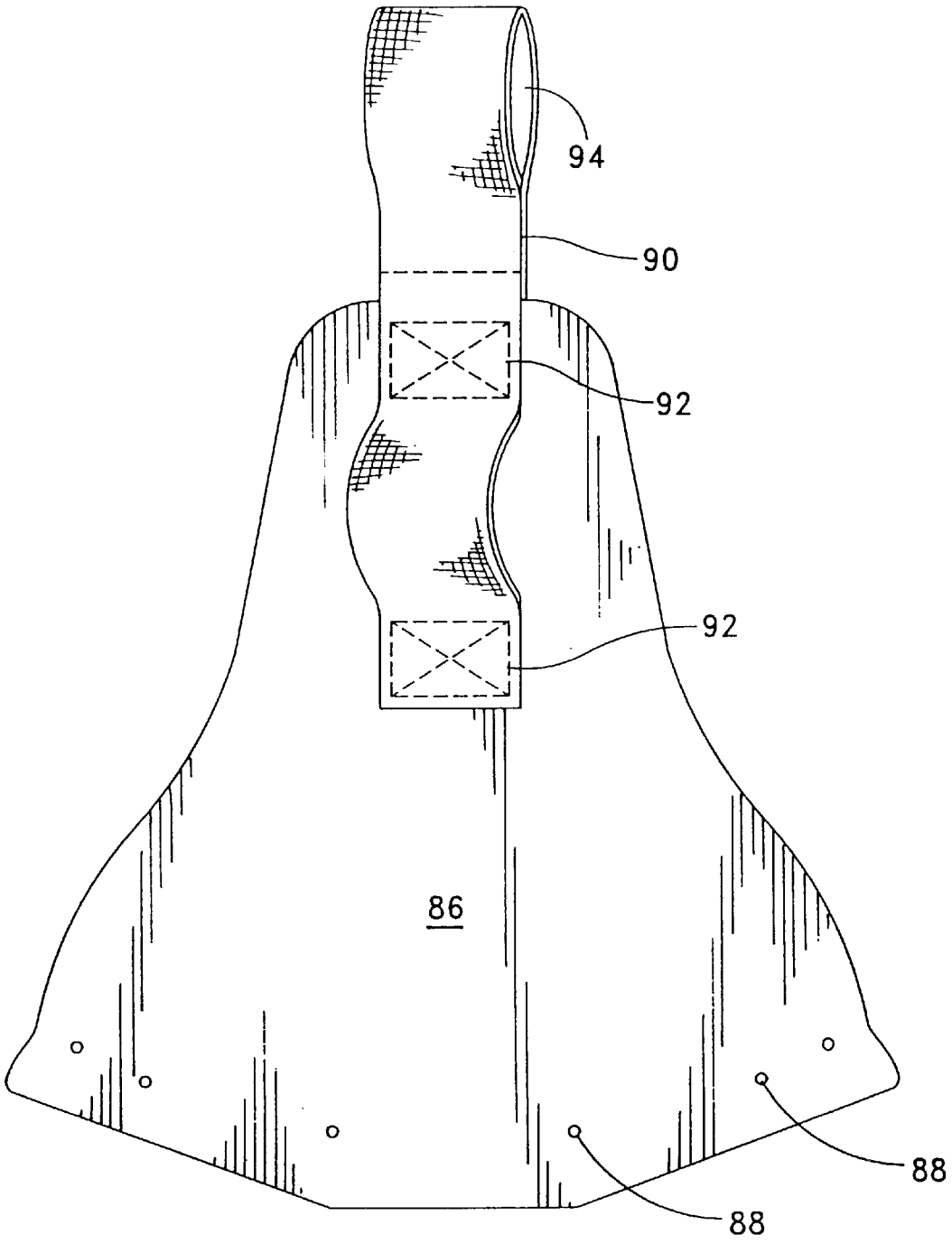
FIG. 10 is a back plan view of a heel receptacle used on the wakeboard binding.

FIG. 10 is a modified heel element 86, modified from heel element 44 having rear holes 88 for securing to the aluminum support plate 16 and having a pull-on, web-type open strap 90 with open loop for pulling 94 to aid in the entry of a user's foot. The web-type strap 90 secured by cross-stitches 92 to the heel element 86. Both the heel receptacle element 44 and the toe receptacle element 46 include an extended-type tongue with two spaced apart holes 68 going through the bonded EMR foam material 70 and 72, generally aligned for use by a user.

Figure 11:
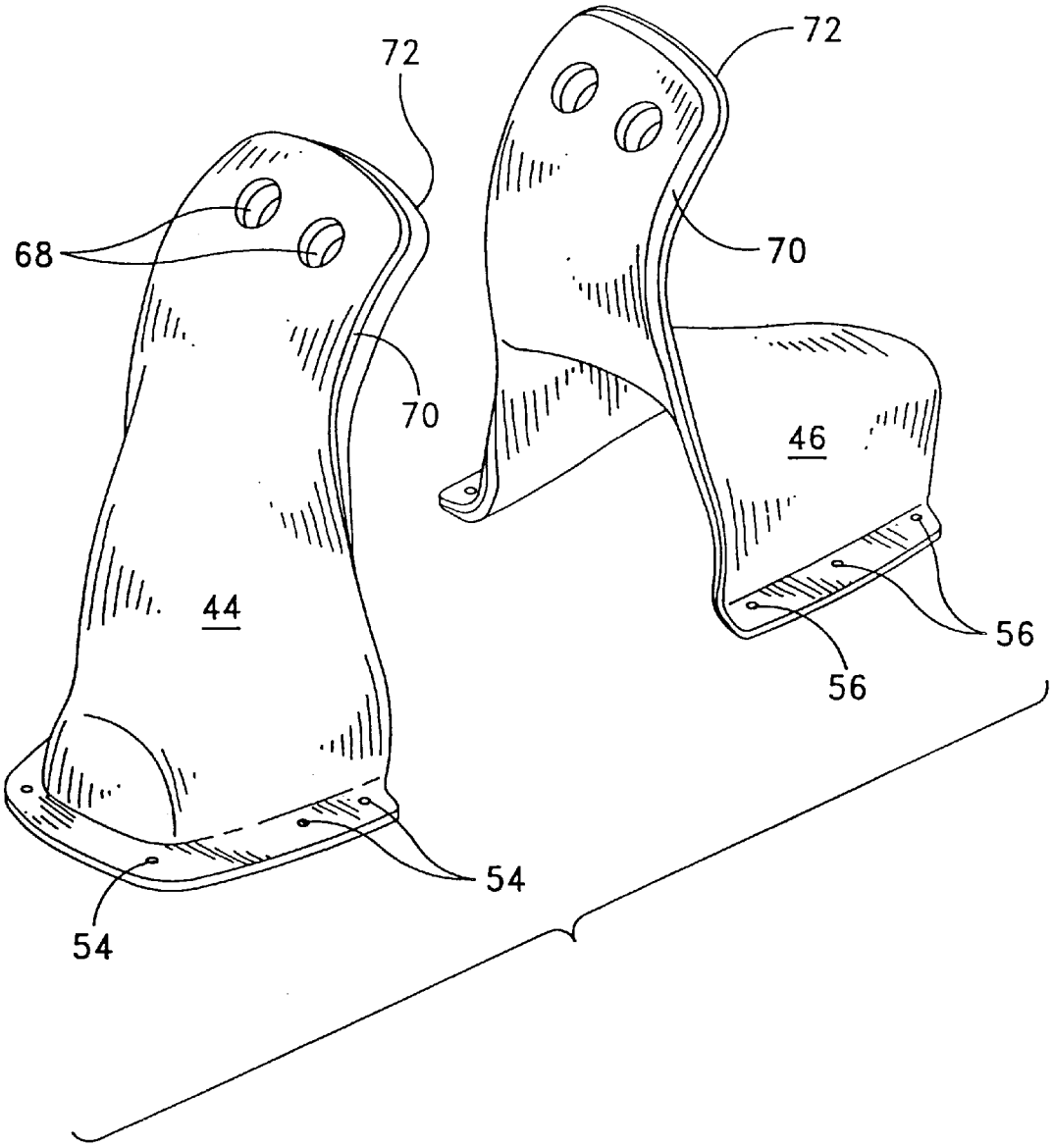
FIG. 11 is a partially exploded perspective view from the side rear of the heel and toe receptacle in the wakeboard binding.

FIG. 11 is an exploded perspective view of the heel and toe elements broken away from the wakeboard binding 14 to illustrate these elements, more particularly, prior to attachment to the aluminum support plate 16 to show these elements in combination form a boot-like receptacle for the foot of a user.

Figure 12:
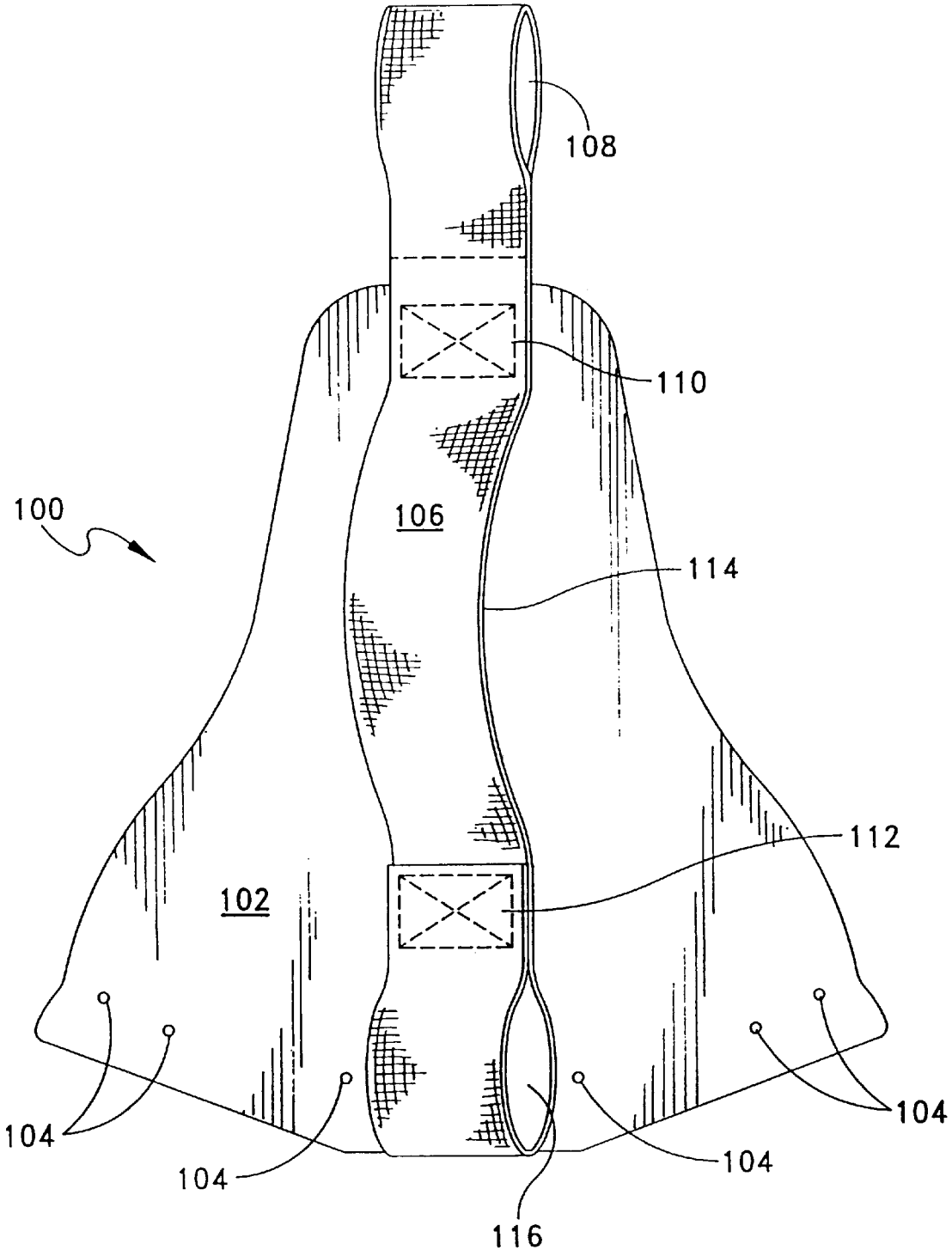
FIG. 12 is a back plan view of a modified strap heel receptacle for a wakeboard binding.

FIG. 12 is a back plan view of a modified strap heel receptacle 100 to form a boot-like enclosure on a wakeboard binding 14. The heel receptacle material 102 comprises a sheet material, typically an elastomeric material like EMR alone or with an inner bonded layer of a flexible foam material. The receptacle includes a plurality of holes 104 to secure the bottom portion of the receptacle by fasteners, like screws or bolts, to a support plate. The receptacle 100 includes a web-type strap 106 extending generally centrally from the top to the bottom of the heel receptacle 100 and forming an upper, user pull on loop 108, an intermediate loop 114, and an anchoring loop 116 through which a horseshoe-type heel clamp bar or other clamp bar is inserted for bolting-screwing to the support plate. The loops 108, 114, and 116 are formed in the single piece of strap material 106 by securely cross-stitching (dotted lines) upper and lower sections 110 and 112 to the heel receptacle material 102. The extended, multiple loop strap 106 permits the user to pull on the binding without damage to the heel material 102.

Figure 13:
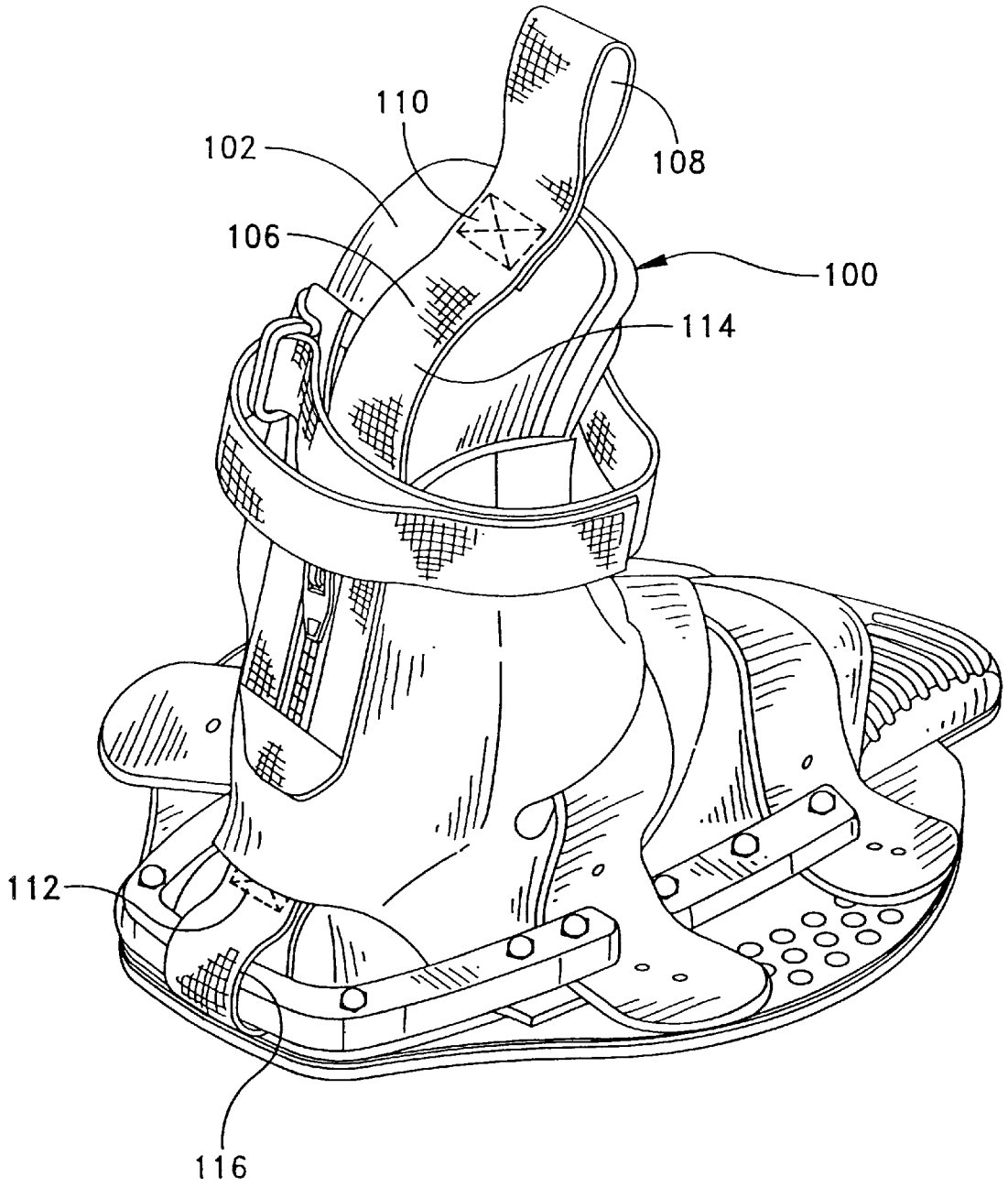
FIG. 13 is a perspective view from above of the strap heel receptacle of FIG. 12 in a wakeboard binding.

FIG. 13 is a perspective plan view from above of a wakeboard binding 14 illustrating the use of the strap heel receptacle 100 in use with the binding 14 and showing the horseshoe-type heel clamp 60 bolted the lower loop 116, and the clamp 60 bolted to the support plate 16, with the horseshoe-type heel clamp 60 extended through the lower loop 116 of the web-type strap 106 to anchor securely the lower strap end.

As it is illustrated in the drawings, the one piece, die cut, binding overlay permits rapid and effective adjustment of the desired tension by crisscrossing the respective upper arms 78 and 82 and the lower arms 80 and 84 across the top surface of the respective heel and toe elements 44 and 46. This arrangement permits clamping of the respective arms 78, 80, 82, and 84 to the desired tension through the holes 58 at the end of each arm, with the open end 92 and rear 74 secured to the aluminum support plate 16. While the zipper 50 permits easy entry into the rear of the boot receptacle.

As set forth, the binding overlay 48; together with the material, construction and adjustment, alone and in combination with the other features of the wakeboard binding 14 as described and disclosed, provides many advantages and improvements over prior art wakeboard bindings.

What is claimed is:

1. A pull-on wakeboard binding, which binding comprises:

a) a heel receptacle and a toe receptacle having an exterior surface of a sheet material to form a boot enclosure for the foot of a user;

b) an overlay binding which extends over the exterior surface of the toe receptacle;

c) a support plate;

d) a clamp means to secure a lower portion of the heel receptacle, toe receptacle, and overlay binding to the support plate;

e) an extended pull-on strap having an upper, open strap loop to aid a user to pull-on the binding; the extended strap having an upper section secured to the exterior surface of the heel receptacle, and a lower section secured to the exterior surface of the heel receptacle, and an intermediate load-transfer loop formed between the upper section and the lower section.

2. The binding of claim 1 wherein the extended pull-on strap is longitudinally positioned and secured by sewn stitches generally centrally on the heel receptacle.

3. The binding of claim 1 wherein the extended pull-on strap comprises a web strap material.

4. The binding of claim 1 wherein the extended strap comprises a woven, integral extended strap with the upper loop extending upwardly from the top of the heel receptacle.

5. A pull-on wakeboard binding, which binding comprises:

a) a wakeboard binding constructed and arranged to form a boot enclosure for the foot of a user and having a heel receptacle with an exterior surface; and b) an extended strap having an upper strap loop extending outwardly from the top of the heel receptacle to aid a user to pull-on the binding; the extended strap having an upper section secured to the exterior surface of the heel receptacle, and a lower section secured to the exterior surface of the heel receptacle, and an intermediate, load-transfer loop formed between the upper section and the lower section.

6. The binding of claim 5 wherein the extended strap comprises a woven, integral strap stitched at the upper section and the lower section.

7. The binding of claim 5 wherein the extended strap extends generally longitudinally and centrally on the exterior surface of the heel receptacle.

8. The binding of claim 5 wherein the binding includes a back closure zipper.

9. The binding of claim 5 which includes an ankle strap with hook and loop fastener material secured to the binding to retain the heel in the heel receptacle.

10. The binding of claim 5 wherein the upper section and lower section are stitched sections generally centrally formed in the upper half of the heel receptacle.

11. A heel receptacle material for use in a wakeboard binding, which material comprises:

a) an elastomeric, flexible sheet material adapted to be formed into a heel receptacle in a wakeboard binding;

b) an extended, pull-on integral strap generally centrally and longitudinal positioned on an exterior surface and having an upper stitched section and a spaced-apart lower stitched section and an intermediate free load-transferring loop between the upper and lower sections; and c) the extended strap having an upper, open pull-on loop extending outwardly from the top of the sheet material.

12. A pull-on wakeboard binding, which binding comprises:

a) a wakeboard binding constructed and arranged to form a boot enclosure for the foot of a user and having a heel receptacle on the exterior surface and a heel clamp; and b) an extended strap having an upper strap loop extending generally outwardly from the top of the heel receptacle to aid a user to pull-on the binding, and a lower strap loop, and the extended strap having at least one section secured to the exterior surface of the heel receptacle between the upper loop and the lower loop, and the lower strap loop is secured to the heel clamp.

13. The binding of claim 12 wherein the strap is secured to the heel receptacle by sewn stitches.

14. The binding of claim 12 wherein the strap extends generally longitudinally and centrally on the heel receptacle.

15. The binding of claim 12 wherein the strap comprises an integral, web strap material, with the upper loop and lower loop formed by folding over the respective ends of the strap.

16. The binding of claim 12 which comprises the one section secured by stitches directly below the upper loop.

* * * * *